US006523355B2

(12) United States Patent
Koster

(10) Patent No.: US 6,523,355 B2
(45) Date of Patent: Feb. 25, 2003

(54) ICE CUBE APPARATUS

(75) Inventor: Roelof Koster, Den Haag (NL)

(73) Assignee: Wiltoe Innovatie B.V., LB Den Haag (NL)

( * ) Notice: Subject to any disclaimer, the term of this patent is extended or adjusted under 35 U.S.C. 154(b) by 0 days.

(21) Appl. No.: 10/033,271

(22) Filed: Oct. 25, 2001

(65) Prior Publication Data

US 2002/0053210 A1 May 9, 2002

Related U.S. Application Data

(63) Continuation of application No. PCT/NL00/00271, filed on Apr. 26, 2000.

(30) Foreign Application Priority Data

Apr. 28, 1999 (NL) ..... 1011915

(51) Int. Cl.[7] ..... F25B 21/02
(52) U.S. Cl. ..... 62/3.63; 62/233; 62/347
(58) Field of Search ..... 62/3.63, 233, 347, 62/74

(56) References Cited

U.S. PATENT DOCUMENTS

| | | | | |
|---|---|---|---|---|
| 2,591,261 A | | 4/1952 | Holahan | |
| 2,756,567 A | | 7/1956 | Martin | |
| 2,778,198 A | | 1/1957 | Heath | |
| 2,907,183 A | | 10/1959 | Roberts | |
| 3,008,308 A | | 11/1961 | Wilbushewich | |
| 3,074,248 A | | 1/1963 | Bauerlein | |
| 3,192,726 A | | 7/1965 | Newton | |
| 3,232,064 A | | 2/1966 | Murphy et al. | |
| 3,306,072 A | | 2/1967 | Dahlgren et al. | |
| 3,661,353 A | | 5/1972 | Newsteder | |
| 3,678,701 A | | 7/1972 | Powell et al. | |
| 4,055,053 A | | 10/1977 | Elfving | |
| 4,375,756 A | * | 3/1983 | Lanzani | 239/469 |
| 4,487,024 A | | 12/1984 | Fletcher et al. | |
| 4,587,810 A | | 5/1986 | Fletcher | |
| 5,697,222 A | | 12/1997 | Lee | |
| 5,836,168 A | | 11/1998 | Lee | |

FOREIGN PATENT DOCUMENTS

| | | |
|---|---|---|
| EP | 0290001 A2 | 9/1988 |
| FR | 2747769 A1 | 10/1997 |
| JP | 63049219 | 9/1989 |
| JP | 06053970 | 10/1995 |

* cited by examiner

*Primary Examiner*—William E. Tapolcai
(74) *Attorney, Agent, or Firm*—Reising, Ethington, Barnes, Kisselle, Learman & McCulloch, PC

(57) ABSTRACT

Ice cube apparatus for the production of ice cubes, comprising a water reservoir with a filling opening, which can be filled with a desired amount of water, an ice cube tray, which is separate from the water reservoir and has at least one mold cavity, water-metering means for supplying a metered amount of water from the water reservoir to the mold cavity, at least one thermoelectric element for freezing the amount of water in the mold cavity, control means with a timer unit for providing current to the thermoelectric element for a defined freezing time, in such a manner that this element extracts heat on the side of the ice cube tray, release means for releasing a frozen ice cube from the ice cube tray after the freezing time, and discharge means for collecting and dicharging the ice cube which has been released from the ice cube tray.

13 Claims, 3 Drawing Sheets

ICE CUBE APPARATUS

CROSS-REFERENCE TO RELATED APPLICATION

This is a continuation application of PCT/NL00/00271 filed Apr. 26, 2000, which PCT application claims priority on NL application number 1011915 filed Apr. 28, 1999, herein incorporated by reference.

FIELD OF THE INVENTION

The invention relates to an ice cube apparatus which is designed in particular as a desktop and/or stand-alone unit and is intended in particular for the consumer market.

BACKGROUND OF THE INVENTION

An ice cube apparatus is known, for example, from U.S. Pat. No. 4,055,053 which, in FIG. 8, shows a housing in which there is a mould chamber. The base of the mould chamber is largely formed by a plurality of mould trays which, on the underside, are connected to thermoelectric elements. The mould chamber is permanently connected to a water system and is kept permanently completely full of water with the aid of a float system. Consequently, the mould trays are always automatically full of water. After the apparatus has been switched to a freezing position, the thermoelectric elements ensure that the water in the mould trays freezes. Then, the power supply to the thermoelectric elements is interrupted, or alternatively these elements are temporarily switched to a heating state, so that heat is supplied to the mould trays for a short time. As a result, the outermost layer of ice melts and the ice cubes are free to float upwards in the mould chamber. The ice cubes can be scooped out of the top side of the mould chamber into an ice bucket with the aid of a chain drive with scoop blades.

A drawback of this known apparatus is that the time which elapses between when the apparatus is switched on and a first series of ice cubes is ready is relatively long. Furthermore, the apparatus comprises a large number of mechanical components, is relatively expensive to produce and is unwieldy. The apparatus can only function with a mould chamber which is completely full, since otherwise the ice cubes which have floated upwards cannot be scooped out of the apparatus. To achieve this, the mould chamber has to be permanently connected to a supply system. The ice cubes which have already been produced remain floating in the water and slowly melt. Furthermore, use of the apparatus is unhygienic, since any contamination remains in the mould chamber and is continuously mixed with fresh water.

Further, FR-A-2,747,769 shows in FIGS. 1 and 2 an apparatus for preparing cold water and ice. Water at ambient temperature can be fed from water bottles which are to be placed on top of the apparatus to a collection bin located inside the apparatus. In a variant, the apparatus may also be connected directly to a water supply system. A controllable valve is provided between the water bottles or the water supply system and the collection tray. From the collection tray, water can be passed via a pump, a system of pipes and a controllable valve to either an external tap or a distribution pipe located inside the apparatus. The distribution pipe is provided with a large number of spray nozzles which are situated just above a cooling body. The cooling body is formed by an inclined, elongate plate with transverse partitions. The spray nozzles atomize water over the cooling body. At one end, the cooling body is connected to a peltier element. In the freezing position of the peltier element, a small amount of the water which reaches the cooling body can freeze on the said body and can grow in layers to a limited extent. The water which does not freeze immediately falls downwards from the cooling body as cooled drops of water and enters the collection bin. At set times, the current direction to the peltier element is reversed, with the result that the bottom layers of ice on the cooling body melt and the discs of ice lying above it slide off the inclined plate and fall onto a collection grate which hangs above the collection tray. On this grate, the discs of ice will begin to melt, the melt water dropping into the collection tray.

It should be noted that this apparatus is intended in particular for the preparation of cold water. The formation of discs of ice is simply a side effect. On the cooling body, it is only possible to freeze ice with a maximum thickness of a few millimeters. The first layers of ice which freeze on the cooling body at the beginning of a freezing cycle provide so much insulation that further progressive growth of ice is impossible. Consequently, only thin discs of ice can be formed. The thin discs of ice will melt away quickly, both on the collection grate and when they are finally used. For this type of combination apparatus, this is more of an advantage than a disadvantage, since the cold melt water contributes to reducing the temperature of the water in the collection bin, which can then be tapped into a glass as cold water via the tap. However, quickly melting discs of ice are very disadvantageous for an ice cube apparatus according to the present invention. This is because in this case cold melt water is an undesirable by-product. The principal product is the production of ice cubes.

Therefore, a drawback of the apparatus described in FR-A2,747,769 is that only a small amount of the water supplied can be effectively converted into ice. Moreover, the ice is of low quality, i.e. it melts very quickly without dissipating much coldness. A further drawback is that the apparatus can only be used in combination with the special bottles which are to be placed on top of the apparatus, or has to be permanently connected to a water supply system. The bottles limit the versatility of the apparatus and, moreover, make it unwieldy and unstable. The water supply system also limits the versatility of the apparatus and, moreover, means that it has to remain in one place. A long time is required to make a first quantity of thin discs of ice. The apparatus has a long start-up time. The water comes out of the bottles at ambient temperature and passes directly into the collection bin, in order then to be cooled slowly by being mixed with water which has been cooled using the cooling body or with melt water. Discs of ice of some thickness can only be made after a sufficiently low temperature of the water in the collection bin has been reached. The mixing is not only slow but also unhygienic, since mixing often takes place with water which has already spent a long time in the apparatus. The thin discs of ice are therefore to a large extent formed from old water.

SUMMARY OF THE INVENTION

The object of the present invention is to provide an apparatus with which the only principal product made is ice cubes and in which the above drawbacks are eliminated. In particular, the invention aims to provide an ice cube apparatus which is inexpensive, compact and operates quickly and hygienically and is suitable in particular for the individual consumer who wants to make a small number of ice cubes from fresh water within a short time.

According to the invention, this object is achieved by means of an ice cube apparatus for producing ice cubes, comprising a water reservoir, a housing, a freezing element which is separate from said water reservoir, pump means for supplying water from said water reservoir to said freezing element, at least one thermoelectric element which is connected in a thermally conductive manner to said freezing element, control means with a timer unit for providing current to said thermoelectric element for a defined freezing time, in such a manner that this element extracts heat from said freezing element, removal means for collecting ice which comes from said freezing element, wherein said water reservoir is located entirely inside said housing and comprises a filling opening, via which said water reservoir can be filled with a desired quantity of water, said freezing element being an ice cube tray which comprises at least one set of a base part and vertical wall parts which, together, delimit a mould cavity having a volume with a depth which is greater than or equal to one centimeter, said pump means being designed to supply said mould cavity with an amount of water which substantially corresponds to said volume of said mould cavity from said water reservoir at a start of a freezing cycle, release means being provided for releasing a frozen ice cube from said mould cavity after said freezing time. The apparatus comprises a thermoelectric element and an ice cube tray which is connected thereto in a thermally conductive manner. The apparatus is provided with its own internal water reservoir which, at the start of a production cycle, can be filled once with a desired amount of water. From the reservoir, the water can be metered to a mould cavity of an ice cube tray with the aid of water-metering means, for example a pressure pump. The mould cavity is at least one centimeter deep and consequently is suitable for the production of ice cubes with a thickness of greater than one centimeter. Control means with a timer unit then ensure that the thermoelectric element is supplied with current for a defined, set freezing time, in such a manner that heat is extracted from the ice cube tray. On the other side of the thermoelectric element, this heat is released again to the environment. After the freezing time has elapsed, release means which release the ice cube from the tray come into operation. The ice cube is collected and removed by removal means which are arranged beneath or next to the tray. The apparatus may comprise its own battery power supply or may be equipped with a plug for connection to an electricity grid. Consequently, the invention provides an ice cube apparatus which operates completely independently. The apparatus simply has to be switched on after the water reservoir has been filled with a defined amount of water. The amount of water can be adapted to the desired number of ice cubes. Then, the apparatus will produce a plurality of ice cubes in succession, in a continuous process, which are collected and removed via the removal means. The apparatus is structurally simple, inexpensive to produce and hygienic to use. The various components interact virtually without any noise and make it possible to construct an apparatus of very small dimensions, for example with a housing which holds the various components and measures 15×15×25 cm. Consequently, the apparatus is eminently suitable for use at home and in hotel rooms and the like. The use of mechanical components, such as controllable valves, is limited, which increases the reliability of the apparatus and means that maintenance is limited to a minimum. Surprisingly it has been found that the time which is required to produce a series of ice cubes of standard size, for example approximately 8 $cm^3$, using the apparatus according to the invention is less than 10 minutes, and in particular only a few minutes.

Preferred embodiments of the invention are defined in the subclaims.

BRIEF DESCRIPTION OF THE DRAWINGS

The invention will be explained in more detail with reference to the appended drawing, in which.

DESCRIPTION OF THE PREFERRED EMBODIMENT

Figure 1:
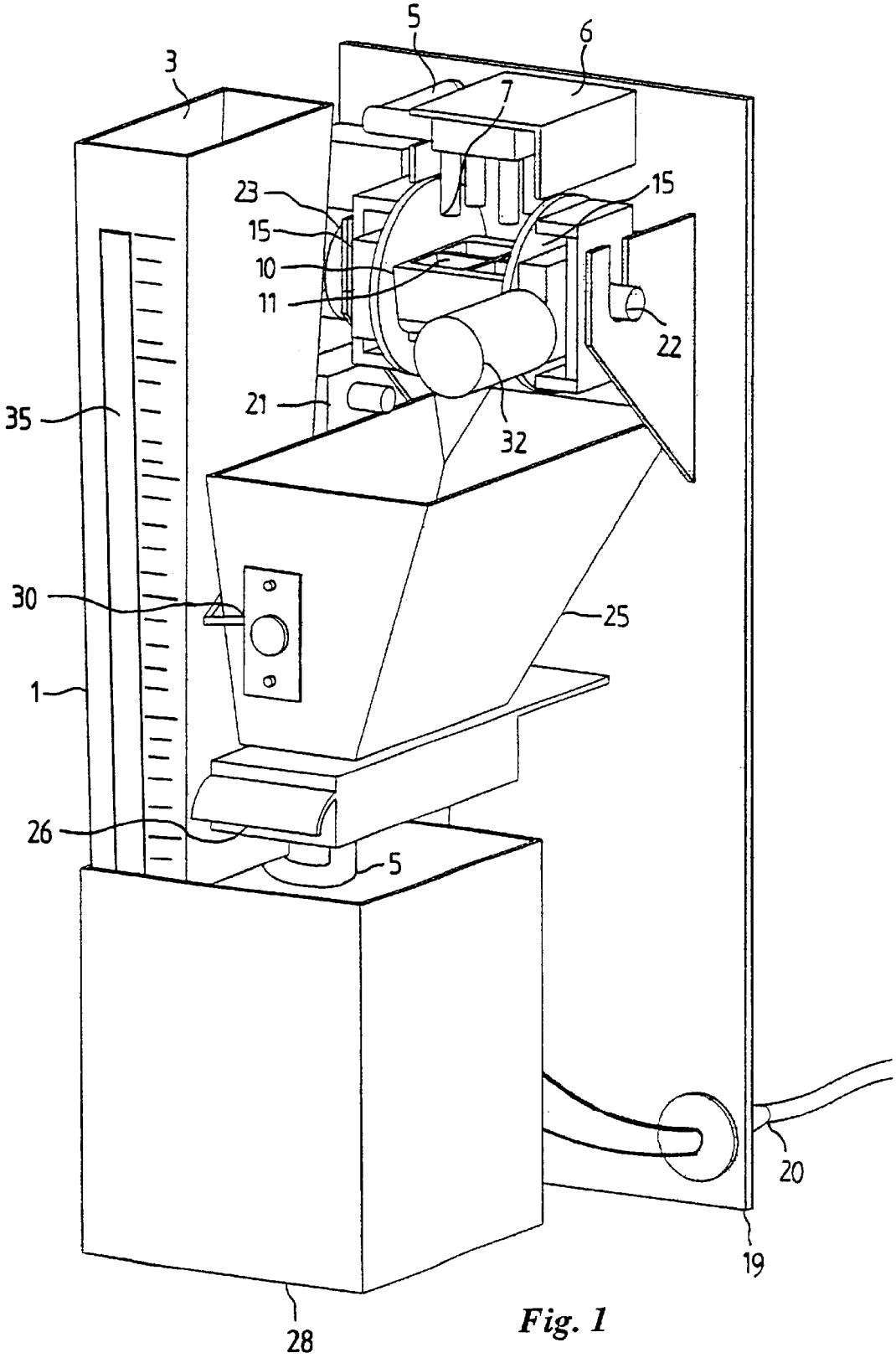
FIG. 1 shows a diagrammatic, perspective view of a first embodiment of the ice cube apparatus according to the invention, with the surrounding housing having been omitted.

In FIG. 1, for the sake of clarity the ice cube apparatus is illustrated without its surrounding housing. The surrounding housing can be shaped as desired with an appearance which, for example, fits in with other consumer electronics and/or kitchen equipment. The apparatus comprises a water reservoir 1 with a filling opening 3. The filling opening 3 may preferably be closed off by a cover. The water reservoir 1 is connected to water-metering means, which in this case are formed by a pump unit. On the pump side, the pump unit is connected to a filler tube 5 which extends upwards from the bottom of the reservoir 1 and opens out into a metering unit 6 with four nozzles 7. In the top of the apparatus, there is an ice cube tray 10 in which there are four mould cavities 11 which can be filled with water via the nozzles 7 at the start of a freezing cycle.

On two opposite sides, the ice cube tray 10 is delimited by thermoelectric elements 15, which in this case are formed by peltier elements. If the peltier elements are connected to a DC voltage source, depending on the current direction, heat will be extracted on one side of the peltier element and an amount of heat will be emitted on the other side. Consequently, the peltier element can act as a heat pump, by means of which it is possible to extract sufficient heat from the ice cube tray 10 for the water in the mould cavities 11 to freeze and form ice cubes.

The various components of the apparatus are attached to a wall plate 19, from which an electricity cable 20 also extends, which can be plugged into a wall socket in order to supply in particular the pump unit and the peltier elements with current. In the apparatus, there are control means 21 which comprise a timer unit for activating the various components of the apparatus in a defined order and for defined times.

The two thermoelectric elements 15, together with the ice cube tray 10 suspended between them, are arranged in such a way that they can rotate about a pivot pin 22. The pivot pin 22 is connected to a drive 23 which is formed, for example, by an electric motor. The drive 23 is activated by the control means 21 and can ensure that the ice cube tray 10 is turned over at set times, so that the ice cubes which have formed in the mould cavities 11 fall out.

A funnel-like collection container 25 is arranged beneath the ice cube tray 10. The collection container 25 is preferably large enough to accommodate a number of ice cubes which corresponds to a full water reservoir 1. On its underside, the collection container 25 is provided with a slide-out drawer 26 for the removal of ice cubes. In its base part, the drawer 26 is provided with one or more leakage openings allowing melt water to flow out. The leakage opening opens out above a leak bin 28. Any melt water, and also water which is spilt during filling of the ice cube tray 10 automatically passes into the leak bin 28, which can be removed from the apparatus and emptied or is provided, on its underside, with a closable outlet opening. The columnar arrangement of the leak bin 28, the collection container 25 and the ice cube tray 10 has the further advantage that, in the event of a power failure, all the melt water which is released from ice cubes which have already been produced is collected in the leak bin 28. The leak bin 28 advantageously ensures that ice cubes are only produced from fresh water. This is of benefit to the taste and, in addition, is hygienic.

During use, the water reservoir 1 is filled with, for example, half a liter of tap water. Then, the apparatus can be switched on by pressing a switch 30. The control means 21 will then begin by switching on the pump unit for a defined filling time, the filling time being precisely sufficient to fill the mould cavities 11 with water. The pump unit is switched off and the thermoelectric elements 15 are switched to a freezing position for a defined freezing time, in which they are supplied with current in such a manner that heat is extracted on the side of the ice cube tray 10. The ice cube tray 10 is simultaneously cooled from two sides to below the freezing point in an efficient and very rapid way, with the result that the water in the mould cavities 11 freezes. During freezing, the heat which is released on those faces of the thermoelectric elements 15 which lie opposite the ice cube tray 10 has to be dissipated. For this purpose, these surfaces may be provided with cooling ribs. Furthermore, there is a fan 32 which, during freezing, releases a flow of air along the cooling ribs. The flow of air is discharged to the atmosphere via a grate in the surrounding housing. After the freezing time has elapsed, the current to the thermoelectric elements 15 is switched off for a defined release time. The heat which is then still stored in the cooling ribs flows back to the ice cube tray 10, with the result that the outer layers of ice of the ice cubes melt and the ice cubes then rest freely inside the mould cavities 11. In a variant, the current direction to the thermoelectric elements 15 is reversed, as a result of which these elements begin to emit heat on the side of the ice cube tray 10. Then, the release means are activated, which in this embodiment means that the drive 23 turns over the ice cube tray 10 and empties it into the collection container 25. A fresh freezing cycle can then begin. The ice cube tray 10 is returned to its original position, the mould cavities 11 are filled again with water, etc. The freezing cycle for freezing four ice cubes will continue to repeat itself automatically until either the water reservoir 1 is empty or the collection container 25 has been completely filled with ice cubes. The water reservoir 1 or the collection container 25 may to this end be fitted with suitable level detectors which emit a signal to the control means 21.

The water reservoir 1 is provided with a scale 35 which indicates the amount of water and the quantity of ice cubes which can be produced with this amount. The scale may also include an indication of the production time required. The amount of ice cubes to be produced can be determined by the user himself by filling the water reservoir 1 to a greater or lesser extent. The water reservoir 1 preferably has a volume of 0.1–1.5 liters, in particular 0.53–1.0 liter. This corresponds to the average requirement for ice cubes while ensuring that the apparatus remains compact and manageable.

Operating on the basis of ice cubes with a volume of approximately 8 $cm^3$, the apparatus has proven able to produce approximately 60 ice cubes within a period of approximately one hour. The freezing time required for the production of a series of four ice cubes, each with a volume of approximately 8 $cm^3$, is less than ten minutes and in particular only a few minutes.

The ice cubes produced are held at a temperature of approximately 0° C. in the collection container 25. The collection container 25 can be insulated or supplied with cold derived from the thermoelectric elements 15. As a result, the ice cubes produced can be stored for a certain time.

The ice cube tray 10 is preferably made from aluminium, which is a good thermal conductor. To further minimize the production time and the amount of energy required, the ice cube tray 10 is designed to be as thin-walled as possible. In a particular embodiment, the mould cavities 11 of the ice cube tray 10 are lined with a layer of teflon, so that the ice cubes can be released from the mould cavities 11 more easily.

In a variant embodiment which is not shown, the ice cube apparatus comprises an ice cube tray with a bottom which can be slid or tilted away and, with the aid of a suitable drive during a release operation, can be moved into an open position. The ice cubes can then fall freely downwards into a collection container arranged below.

Figure 2:
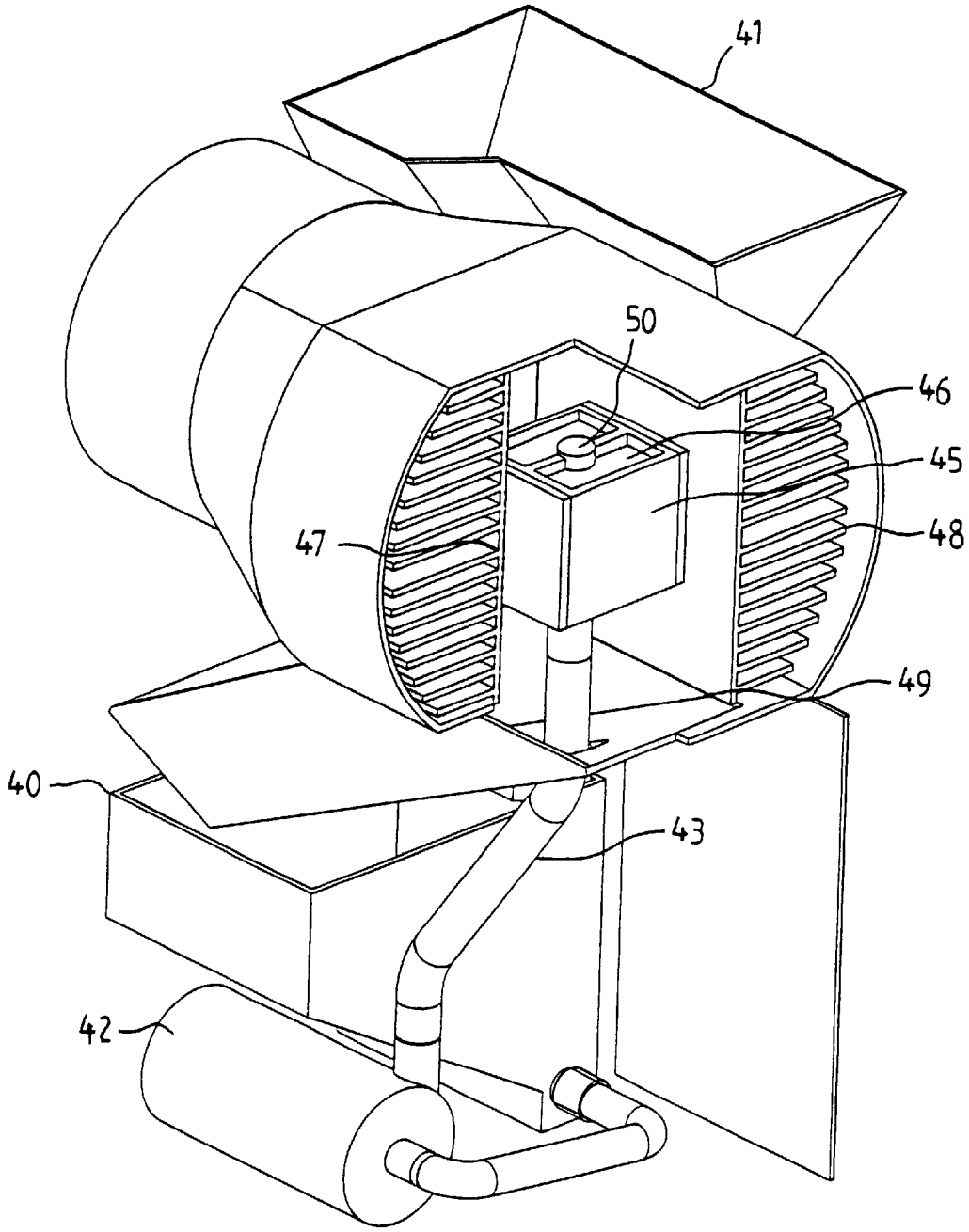
FIG. 2 shows a view corresponding to FIG. 1 of a preferred embodiment of an ice cube apparatus in a freezing position.

FIG. 2 shows a variant embodiment of the ice cube apparatus. In this FIG. too, the surrounding housing has been omitted for the sake of clarity. The apparatus comprises a water reservoir 40 with a filling funnel 41 and a pump unit 42, which is connected to the reservoir and, via a filling tube 43, is connected to an ice cube tray 45 with two mould cavities 46. The ice cube tray 45 is delimited on two sides by two peltier elements 47 with cooling ribs 48. Beneath the ice cube tray 45 there is a collection container 49, which in this case is formed by an inclined chute which opens out into a closable dispensing opening.

Figure 3:
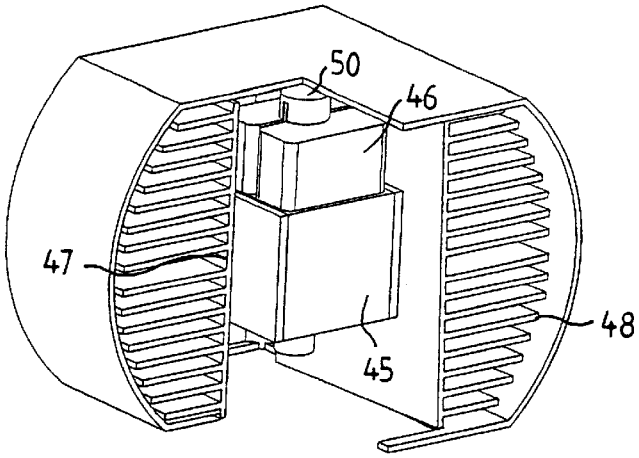
FIG. 3 shows a partial view of FIG. 2, in a release position.

The ice cube tray 45 comprises an insert element 50 which can be moved up and down between a bottom position (FIG. 2) and a top position (FIG. 3). The insert element 50 comprises a lifting part which, in the bottom position, bears against the base of the mould cavity 44. If, during a release operation after freezing, the insert element 50 is moved upwards into the top position, the lifting part pushes the ice cube upwards with it until ultimately it is tipped over the edge of the ice cube tray 45 and falls into the collection container 49.

The insert element 50 can be moved up and down using any suitable drive. Advantageously, however, water pressure from the pump unit 48 is used. In this case, it is even possible to fill the mould cavities 46 with water while the insert element 50 is moving upwards. In this way, the release of the ice cubes is combined with the operation of filling the mould cavities, which saves time and eliminates the need for a separate drive for the release means. The above release principle will be explained in more detail with reference to a variant of an ice cube tray with insert element which is shown in FIGS. 4 and 5.

Figure 4:
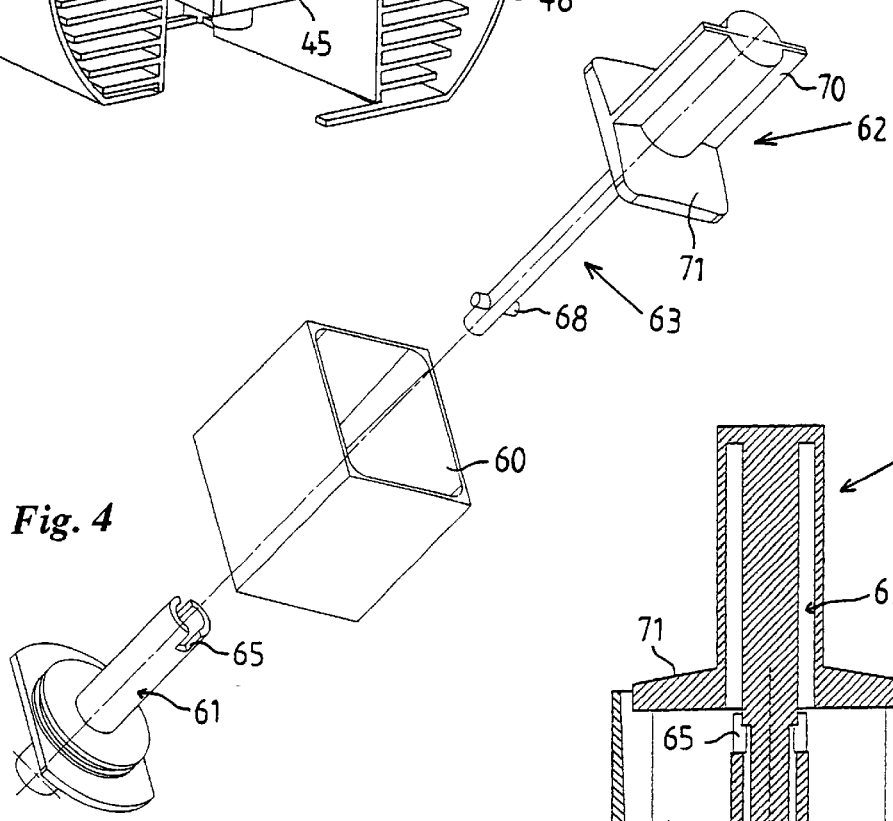
FIG. 4 shows a perspective view, with exploded components, of an ice cube tray with cylinder part and an insert element with piston part.
Figure 5:
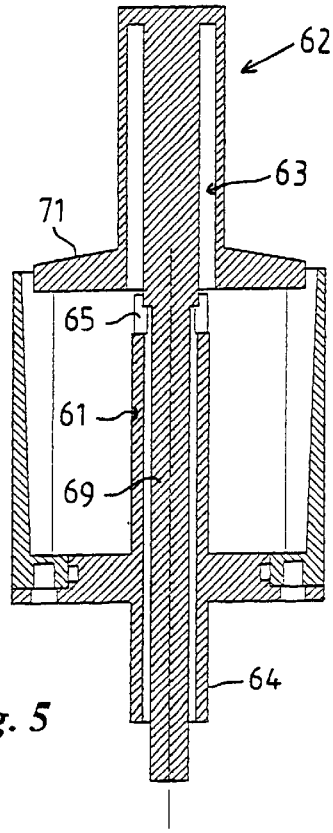
FIG. 5 shows a cross-sectional view through the assembled components from FIG. 4, in a release position.

In FIGS. 4 and 5, the ice cube tray 60 is of cuboidal design and has a circular recess arranged in its base. A filler piece with a cylinder part 61 is arranged in the ice cube tray 60 from below. An insert element 62 is arranged above the top section of the cylinder part 61, in such a way that it can slide up and down. The insert element 62 comprises a piston part 63 which rests inside the cylinder part 61. The piston-cylinder system which is formed in this way can be connected, by means of a connection port 64, to, for example, the filler tube 43 of the pump unit 42 of the ice cube apparatus shown in FIG. 2. When the pump unit is set in operation, the water pressure built up ensures that the piston part 63, together with the rest of the insert element 62, is pushed upwards with respect to the cylinder part 61 and the ice cube tray 60. The upwards travel can be limited by a stop pin 68 mounted in the piston part 63 or by the top side of the insert element 62 coming into contact with a spring means or stop wall.

As can be seen in FIG. 5, the cylinder part 61 is provided on its top side with two inlet openings 65 which, in the top position of the insert element 62, are opened by a narrowing 69 in the piston part 63. From that moment, the water can flow into the mould cavities. When the mould cavities have been filled, the pump unit can be switched off, with the result that the water pressure drops and the insert element 62 can move back into its bottom position, for example under the influence of a spring means or the force of gravity.

The insert element 62 has a vertical wall part 70 which forms a partition between the mould cavities in the ice cube tray 60. In addition, the insert element 62 comprises two lifting parts 71 which extend on either side of the vertical wall part 70. The two lifting parts 71 are inclined, ensuring that, in the top position of the insert element 62, the two ice cubes are pushed outwards over the sides of the ice cube tray 60. This is advantageous in particular if the assembly of ice cube tray 60 and insert element 62 is clamped between two thermoelectric elements, since the release direction can then be directed between the two thermoelectric elements.

It is advantageously possible to make the lifting parts 71 and the vertical wall 70 of any desired shape. In this way, the final shape of the ice cubes is defined, so that they can be given an attractive appearance. Since, in addition, the insert element 70 is easy to exchange, the ice cube apparatus can easily and quickly be adapted to a desired shape of ice cube, for example with the logo of a hotel chain.

The release principle illustrated in FIG. 2 may advantageously also be employed in FIG. 1, and vice versa, so that in this case too the fresh water is kept separate from water which has already been used or used water is returned to the water reservoir for reuse.

Consequently, the invention provides an ice cube apparatus which operates simply, quickly and effectively and is of acceptably small size, making the apparatus very suitable for use as a stand-alone unit in, for example, a home or a hotel room. In addition to the embodiments shown, numerous variants are conceivable. For example, the water reservoir may be arranged removably in the housing, so that it can be taken out of the apparatus and filled beneath a tap. It is also possible for the collection container to be fitted removably. To collect melt water, a separate leak bin may be provided beneath the removal means. Keeping the melt water outside the water reservoir in this way advantageously ensures that only fresh water is used to make the ice cubes.

What is claimed is:

1. Desktop and/or stand-alone apparatus for producing ice cubes, comprising:

a water reservoir;

a housing;

a freezing element which is separate from said water reservoir;

pump means for supplying water from said water reservoir to said freezing element;

at least one thermoelectric element which is connected in a thermally conductive manner to said freezing element;

control means with a timer unit for providing current to said thermoelectric element for a defined freezing time, in such a manner that this element extracts heat from said freezing element;

removal means for collecting ice which comes from said freezing element; wherein said water reservoir is located entirely inside said housing and comprises a filling opening to the exterior of said housing, via which said water reservoir can be filled with a desired quantity of water, said freezing element being an ice cube tray which comprises at least one set of a base part and vertical wall parts which, together, delimit a mould cavity having a volume with a depth which is greater than or equal to one centimeter, said pump means being designed to supply said mould cavity with an amount of water which substantially corresponds to said volume of said mould cavity from said water reservoir at a start of a freezing cycle, release means being provided for releasing a frozen ice cube from said mould cavity after said freezing time.

2. Apparatus according to claim 1, in which said water reservoir has a volume of at least 0.1 liter.

3. Apparatus according to claim 1, in which said water reservoir has a volume of at most 1.5 liters.

4. Apparatus for producing ice cubes, comprising:

a water reservoir;

a housing;

a freezing element which is separate from said water reservoir;

pump means for supplying water from said water reservoir to said freezing element;

at least one thermoelectric element which is connected in a thermally conductive manner to said freezing element;

control means with a timer unit for providing current to said thermoelectric element for a defined freezing time, in such a manner that this element extracts heat from said freezing element;

removal means for collecting ice which comes from said freezing element; wherein said water reservoir is located entirely inside said housing and comprises a filling opening, via which said water reservoir can be filled with a desired quantity of water, said freezing element being an ice cube tray which comprises at least one set of a base part and vertical wall parts which, together, delimit a mould cavity having a volume with a depth which is greater than or equal to one centimeter, said pump means being designed to supply said mould cavity with an amount of water which substantially corresponds to said volume of said mould cavity from said water reservoir at a start of a freezing cycle, release means being provided for releasing a frozen ice cube from said mould cavity after said freezing time; and said water reservoir comprises a scale for indicating an amount of water with which it is to be filled, which substantially corresponds to a number of ice cubes which it is desired to produce.

5. Apparatus for producing ice cubes, comprising:

a water reservoir;

a housing;

a freezing element which is separate from said water reservoir;

pump means for supplying water from said water reservoir to said freezing element;

at least one thermoelectric element which is connected in a thermally conductive manner to said freezing element;

control means with a timer unit for providing current to said thermoelectric element for a defined freezing time, in such a manner that this element extracts heat from said freezing element;

removal means for collecting ice which comes from said freezing element; wherein said water reservoir is located entirely inside said housing and comprises a filling opening, via which said water reservoir can be filled with a desired quantity of water, said freezing element being an ice cube tray which comprises at least one set of a base part and vertical wall parts which, together, delimit a mould cavity having a volume with a depth which is greater than or equal to one centimeter, said pump means being designed to supply said mould cavity with an amount of water which substantially corresponds to said volume of said mould cavity from said water reservoir at a start of a freezing cycle, release means being provided for releasing a frozen ice cube from said mould cavity after said freezing time; and said control means comprise a level detector in said water reservoir, for switching off said apparatus if said water reservoir is empty.

6. Apparatus for producing ice cubes, comprising:

a water reservoir;

a housing;

a freezing element which is separate from said water reservoir;

pump means for supplying water from said water reservoir to said freezing element;

at least one thermoelectric element which is connected in a thermally conductive manner to said freezing element;

control means with a timer unit for providing current to said thermoelectric element for a defined freezing time, in such a manner that this element extracts heat from said freezing element;

removal means for collecting ice which comes from said freezing element; wherein said water reservoir is located entirely inside said housing and comprises a filling opening, via which said water reservoir can be filled with a desired quantity of water, said freezing element being an ice cube tray which comprises at least one set of a base part and vertical wall parts which, together, delimit a mould cavity having a volume with a depth which is greater than or equal to one centimeter, said pump means being designed to supply said mould cavity with an amount of water which substantially corresponds to said volume of said mould cavity from said water reservoir at a start of a freezing cycle, release means being provided for releasing a frozen ice cube from said mould cavity after said freezing time; and in which two thermoelectric elements are provided, which delimit said ice cube tray on two substantially opposite sides.

7. Apparatus for producing ice cubes, comprising:

a water reservoir;

a housing;

a freezing element which is separate from said water reservoir;

pump means for supplying water from said water reservoir to said freezing element;

at least one thermoelectric element which is connected in a thermally conductive manner to said freezing element;

control means with a timer unit for providing current to said thermoelectric element for a defined freezing time, in such a manner that this element extracts heat from said freezing element;

removal means for collecting ice which comes from said freezing element; wherein said water reservoir is located entirely inside said housing and comprises a filling opening, via which said water reservoir can be filled with a desired quantity of water, said freezing element being an ice cube tray which comprises at least one set of a base part and vertical wall parts which, together, delimit a mould cavity having a volume with a depth which is greater than or equal to one centimeter, said pump means being designed to supply said mould cavity with an amount of water which substantially corresponds to said volume of said mould cavity from said water reservoir at a start of a freezing cycle, release means being provided for releasing a frozen ice cube from said mould cavity after said freezing time; and in which a leak bin is provided for collecting melt water, which leak bin is separate from said water reservoir.

8. Apparatus according to claim 7, in which said leak bin is arranged in a manner of a column beneath said collection container and said ice cube tray.

9. Apparatus for producing ice cubes, comprising:

a water reservoir;

a housing;

a freezing element which is separate from said water reservoir;

pump means for supplying water from said water reservoir to said freezing element;

at least one thermoelectric element which is connected in a thermally conductive manner to said freezing element;

control means with a timer unit for providing current to said thermoelectric element for a defined freezing time, in such a manner that this element extracts heat from said freezing element;

removal means for collecting ice which comes from said freezing element; wherein said water reservoir is located entirely inside said housing and comprises a filling opening, via which said water reservoir can be filled with a desired quantity of water, said freezing element being an ice cube tray which comprises at least one set of a base part and vertical wall parts which, together, delimit a mould cavity having a volume with a depth which is greater than or equal to one centimeter, said pump means being designed to supply said mould cavity with an amount of water which substantially corresponds to said volume of said mould cavity from said water reservoir at a start of a freezing cycle, release means being provided for releasing a frozen ice cube from said mould cavity after said freezing time;

said ice cube tray being open at the top and comprises an insert element which can move up and down in said mould cavity and has a lifting part which, in a bottom position, bears against said base part of said mould cavity, and in which said release means comprise a drive for moving said insert element upwards during the release operation and, in a top position, tipping an ice cube which has been produced over an edge of said ice cube tray.

10. Apparatus according to claim 9, in which said lifting part is bevelled towards a desired direction of tipping.

11. Apparatus according to claim 9, in which said drive for moving said insert element upwards is formed by said pump means.

12. Apparatus according to claim 11, in which said insert element comprises a piston part and said ice cube tray comprises a cylinder part, together forming a piston-cylinder system, which piston-cylinder system is connected to said pump means.

13. Apparatus according to claim 9, in which said ice cube tray is provided with an inlet opening, which inlet opening can be closed off by said insert element, which inlet opening is coupled to said pump means, and which inlet opening, during upwards movement of said insert element, is opened in order for said mould cavity to be filled with water.

* * * * *